US010186198B2

(12) United States Patent
Kim et al.

(10) Patent No.: US 10,186,198 B2
(45) Date of Patent: Jan. 22, 2019

(54) GATE DRIVING CIRCUIT

(71) Applicant: Samsung Display Co., Ltd., Yongin-si (KR)

(72) Inventors: Jonghee Kim, Yongin-si (KR); Youngwan Seo, Suwon-si (KR); Jaekeun Lim, Suwon-si (KR); Chongchul Chai, Seoul (KR)

(73) Assignee: SAMSUNG DISPLAY CO., LTD., Yongin-si (KR)

( * ) Notice: Subject to any disclaimer, the term of this patent is extended or adjusted under 35 U.S.C. 154(b) by 631 days.

(21) Appl. No.: 14/834,015

(22) Filed: Aug. 24, 2015

(65) Prior Publication Data

US 2016/0203762 A1 Jul. 14, 2016

(30) Foreign Application Priority Data

Jan. 14, 2015 (KR) ..... 10-2015-0006808

(51) Int. Cl.

| | |
|---|---|
| ***G09G 3/32*** | (2016.01) |
| ***G09G 3/3258*** | (2016.01) |
| ***G09G 3/3291*** | (2016.01) |
| ***G09G 3/36*** | (2006.01) |

(52) U.S. Cl.

CPC ..... *G09G 3/3258* (2013.01); *G09G 3/3291* (2013.01); *G09G 3/3677* (2013.01); *G09G 2300/0408* (2013.01); *G09G 2310/0286* (2013.01); *G09G 2330/028* (2013.01)

(58) Field of Classification Search

None

See application file for complete search history.

(56) References Cited

U.S. PATENT DOCUMENTS

| | | | | |
|---|---|---|---|---|
| 2011/0279420 | A1 | 11/2011 | Sung et al. | |
| 2012/0194773 | A1* | 8/2012 | Kim | G02F 1/13336 349/139 |
| 2014/0092078 | A1 | 4/2014 | Yoon et al. | |
| 2015/0042383 | A1 | 2/2015 | Kwon et al. | |
| 2015/0042638 | A1 | 2/2015 | Kwon et al. | |
| 2015/0042689 | A1 | 2/2015 | Kim et al. | |
| 2015/0077407 | A1 | 3/2015 | Kim et al. | |
| 2015/0263722 | A1 | 9/2015 | Kim et al. | |

(Continued)

FOREIGN PATENT DOCUMENTS

| | | |
|---|---|---|
| CN | 103714789 | 4/2014 |
| EP | 2 713 361 | 4/2014 |

(Continued)

*Primary Examiner* — Carl Adams

(74) *Attorney, Agent, or Firm* — H.C. Park & Associates, PLC

(57) ABSTRACT

A gate driving circuit includes a first driving stage driving a first gate line included in a display panel. The first driving stage includes a first output transistor outputting a first carry signal on the basis of a first clock signal in response to a voltage of a first node, a second output transistor outputting a first gate signal on the basis of the first clock signal in response to the voltage of the first node, a first control transistor applying a second clock signal to a second node, a second control transistor applying a start signal to the first node in response to a voltage of the second node, and a third control transistor applying a first discharge voltage to the first node in response to the first carry signal.

20 Claims, 11 Drawing Sheets

(56) References Cited

U.S. PATENT DOCUMENTS

| | | | |
|---|---|---|---|
| 2015/0287392 | A1 | 10/2015 | Kim et al. |
| 2015/0358018 | A1 | 12/2015 | Kim et al. |

FOREIGN PATENT DOCUMENTS

| | | |
|---|---|---|
| JP | 2011-204326 | 10/2011 |
| JP | 5496270 | 3/2014 |
| JP | 2014-071452 | 4/2014 |
| KR | 10-2010-0073294 | 7/2010 |
| KR | 10-2010-0081146 | 7/2010 |
| KR | 10-2014-0099025 | 8/2014 |
| KR | 10-2015-0017810 | 2/2015 |
| KR | 10-2015-0018969 | 2/2015 |
| KR | 10-2015-0018970 | 2/2015 |
| KR | 10-2015-0019098 | 2/2015 |
| KR | 10-2015-0031899 | 3/2015 |
| KR | 10-2015-0086771 | 7/2015 |
| KR | 10-2015-0086973 | 7/2015 |

* cited by examiner

GATE DRIVING CIRCUIT

CROSS-REFERENCE TO RELATED APPLICATION

This application claims priority from and the benefit of Korean Patent Application No. 10-2015-0006808, filed on Jan. 14, 2015, which is hereby incorporated by reference for all purposes as if fully set forth herein.

BACKGROUND

Field

Exemplary embodiments relate to a gate driving circuit. More particularly, exemplary embodiments relate to a gate driving circuit integrated on a display panel.

Discussion of the Background

A display device typically includes gate lines, data lines, and pixels. Each of the pixels is connected to a corresponding gate line of the gate lines and a corresponding data line of the data lines. The display device includes a gate driving circuit to control the gate lines and a data driving circuit to control the data lines. The gate driving circuit applies gate signals to the gate lines, respectively, and a data driving circuit applies data signals to the data lines, respectively.

The gate driving circuit may include a shift register configured to include driving stage circuits, e.g., driving stages. Each driving stage outputs the gate signal corresponding to the gate line. Each driving stage includes transistors connected to each other.

The above information disclosed in this Background section is only for enhancement of understanding of the background of the inventive concept, and, therefore, it may contain information that does not form the prior art that is already known in this country to a person of ordinary skill in the art.

SUMMARY

Exemplary embodiments provide a gate driving circuit having improved capability and reliability.

Additional aspects will be set forth in the detailed description which follows, and, in part, will be apparent from the disclosure, or may be learned by practice of the inventive concept.

An exemplary embodiment discloses a gate driving circuit including a plurality of driving stages driving a plurality of gate lines included in a display panel. Among the driving stages, a first driving stage, which drives a first gate line of the gate lines, includes a first output transistor outputting a first carry signal on the basis of a first clock signal in response to a voltage of a first node, a second output transistor outputting a first gate signal on the basis of the first clock signal in response to the voltage of the first node, a first control transistor applying a second clock signal having a phase different from a phase of the first clock signal to a second node, a second control transistor applying a start signal to the first node in response to a voltage of the second node, and a third control transistor applying a first discharge voltage to the first node in response to the first carry signal.

An exemplary embodiment also discloses a gate driving circuit including a plurality of driving stages respectively driving a plurality of gate lines included in a display panel. Among the driving stages, a first driving stage includes an output part outputting a first carry signal and a first gate signal, which are generated on the basis of a clock signal, in response to a voltage of a first node, an inverter part outputting a switching signal of a second node in response to the clock signal, a pull-down part decreasing the first carry signal and the first gate signal in response to a second carry signal, which is provided from a second driving stage applied with the first carry signal among the driving stages, and the switching signal, and a control part receiving a start signal from an external source and controlling the voltage of the first node in response to the start signal, the first carry signal, and the switching signal. The control part charges the voltage of the first node in response to the switching signal and the start signal.

The foregoing general description and the following detailed description are exemplary and explanatory and are intended to provide further explanation of the claimed subject matter.

BRIEF DESCRIPTION OF THE DRAWINGS

The accompanying drawings, which are included to provide a further understanding of the inventive concept, and are incorporated in and constitute a part of this specification, illustrate exemplary embodiments of the inventive concept, and, together with the description, serve to explain principles of the inventive concept.

DETAILED DESCRIPTION OF THE ILLUSTRATED EMBODIMENTS

Figure 1:
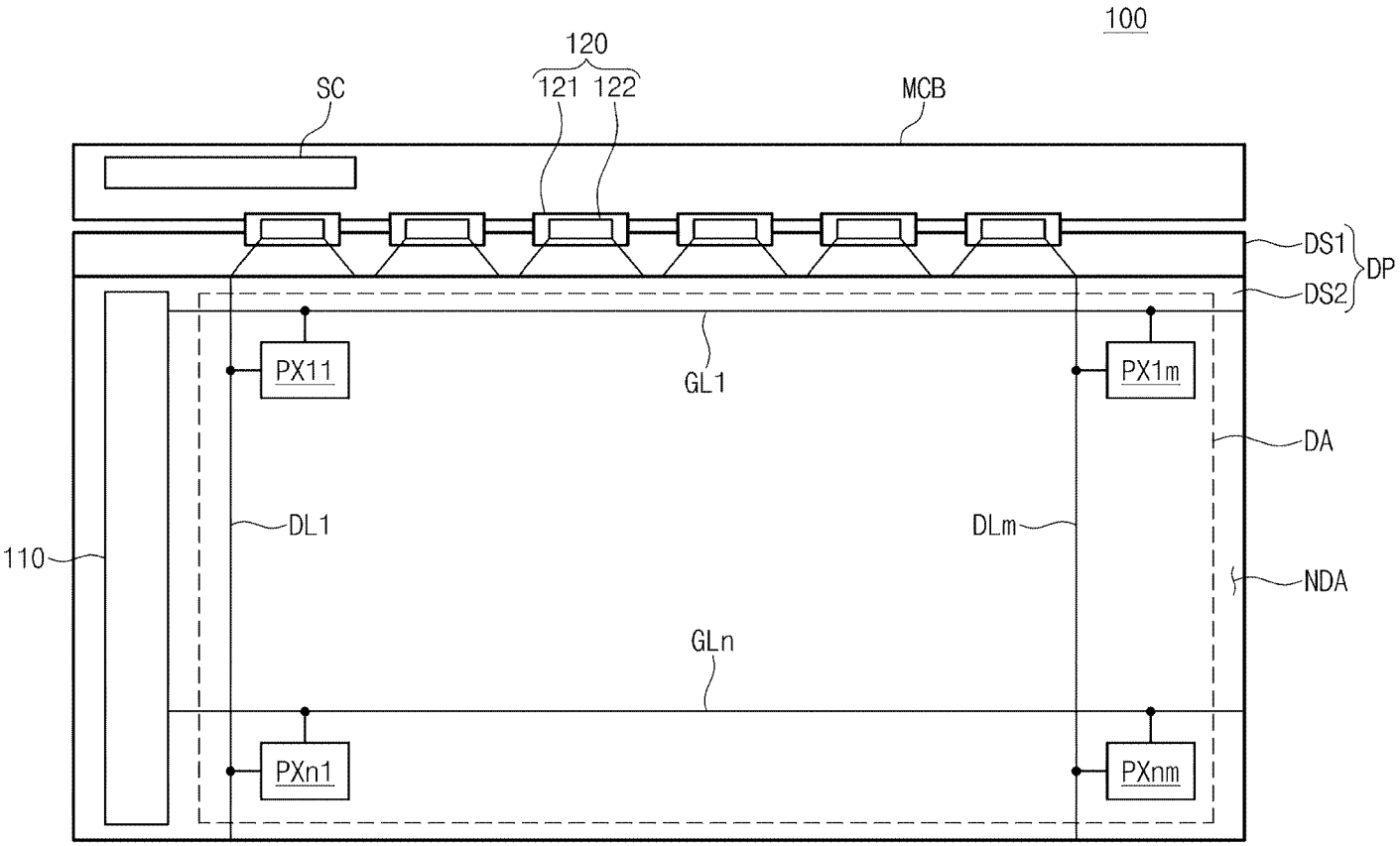
FIG. 1 is a plan view showing a display device according to an exemplary embodiment.

In the following description, for the purposes of explanation, numerous specific details are set forth in order to provide a thorough understanding of various exemplary embodiments. It is apparent, however, that various exemplary embodiments may be practiced without these specific details or with one or more equivalent arrangements. In other instances, well-known structures and devices are shown in block diagram form in order to avoid unnecessarily obscuring various exemplary embodiments.

In the accompanying figures, the size and relative sizes of layers, films, panels, regions, etc., may be exaggerated for clarity and descriptive purposes. Also, like reference numerals denote like elements.

When an element or layer is referred to as being "on," "connected to," or "coupled to" another element or layer, it may be directly on, connected to, or coupled to the other element or layer or intervening elements or layers may be present. When, however, an element or layer is referred to as being "directly on," "directly connected to," or "directly coupled to" another element or layer, there are no intervening elements or layers present. For the purposes of this disclosure, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. Like numbers refer to like elements throughout. As used herein, the term "and/or" includes any and all combinations of one or more of the associated listed items.

Although the terms first, second, etc. may be used herein to describe various elements, components, regions, layers, and/or sections, these elements, components, regions, layers, and/or sections should not be limited by these terms. These terms are used to distinguish one element, component, region, layer, and/or section from another element, component, region, layer, and/or section. Thus, a first element, component, region, layer, and/or section discussed below could be termed a second element, component, region, layer, and/or section without departing from the teachings of the present disclosure.

Spatially relative terms, such as "beneath," "below," "lower," "above," "upper," and the like, may be used herein for descriptive purposes, and, thereby, to describe one element or feature's relationship to another element(s) or feature(s) as illustrated in the drawings. Spatially relative terms are intended to encompass different orientations of an apparatus in use, operation, and/or manufacture in addition to the orientation depicted in the drawings. For example, if the apparatus in the drawings is turned over, elements described as "below" or "beneath" other elements or features would then be oriented "above" the other elements or features. Thus, the exemplary term "below" can encompass both an orientation of above and below. Furthermore, the apparatus may be otherwise oriented (e.g., rotated 90 degrees or at other orientations), and, as such, the spatially relative descriptors used herein interpreted accordingly.

The terminology used herein is for the purpose of describing particular embodiments and is not intended to be limiting. As used herein, the singular forms, "a," "an," and "the" are intended to include the plural forms as well, unless the context clearly indicates otherwise. Moreover, the terms "comprises," "comprising," "includes," and/or "including," when used in this specification, specify the presence of stated features, integers, steps, operations, elements, components, and/or groups thereof, but do not preclude the presence or addition of one or more other features, integers, steps, operations, elements, components, and/or groups thereof.

Various exemplary embodiments are described herein with reference to sectional illustrations that are schematic illustrations of idealized exemplary embodiments and/or intermediate structures. As such, variations from the shapes of the illustrations as a result, for example, of manufacturing techniques and/or tolerances, are to be expected. Thus, exemplary embodiments disclosed herein should not be construed as limited to the particular illustrated shapes of regions, but are to include deviations in shapes that result from, for instance, manufacturing. For example, an implanted region illustrated as a rectangle will, typically, have rounded or curved features and/or a gradient of implant concentration at its edges rather than a binary change from implanted to non-implanted region. Likewise, a buried region formed by implantation may result in some implantation in the region between the buried region and the surface through which the implantation takes place. Thus, the regions illustrated in the drawings are schematic in nature and their shapes are not intended to illustrate the actual shape of a region of a device and are not intended to be limiting.

Unless otherwise defined, all terms (including technical and scientific terms) used herein have the same meaning as commonly understood by one of ordinary skill in the art to which this disclosure is a part. Terms, such as those defined in commonly used dictionaries, should be interpreted as having a meaning that is consistent with their meaning in the context of the relevant art and will not be interpreted in an idealized or overly formal sense, unless expressly so defined herein.

Figure 2:
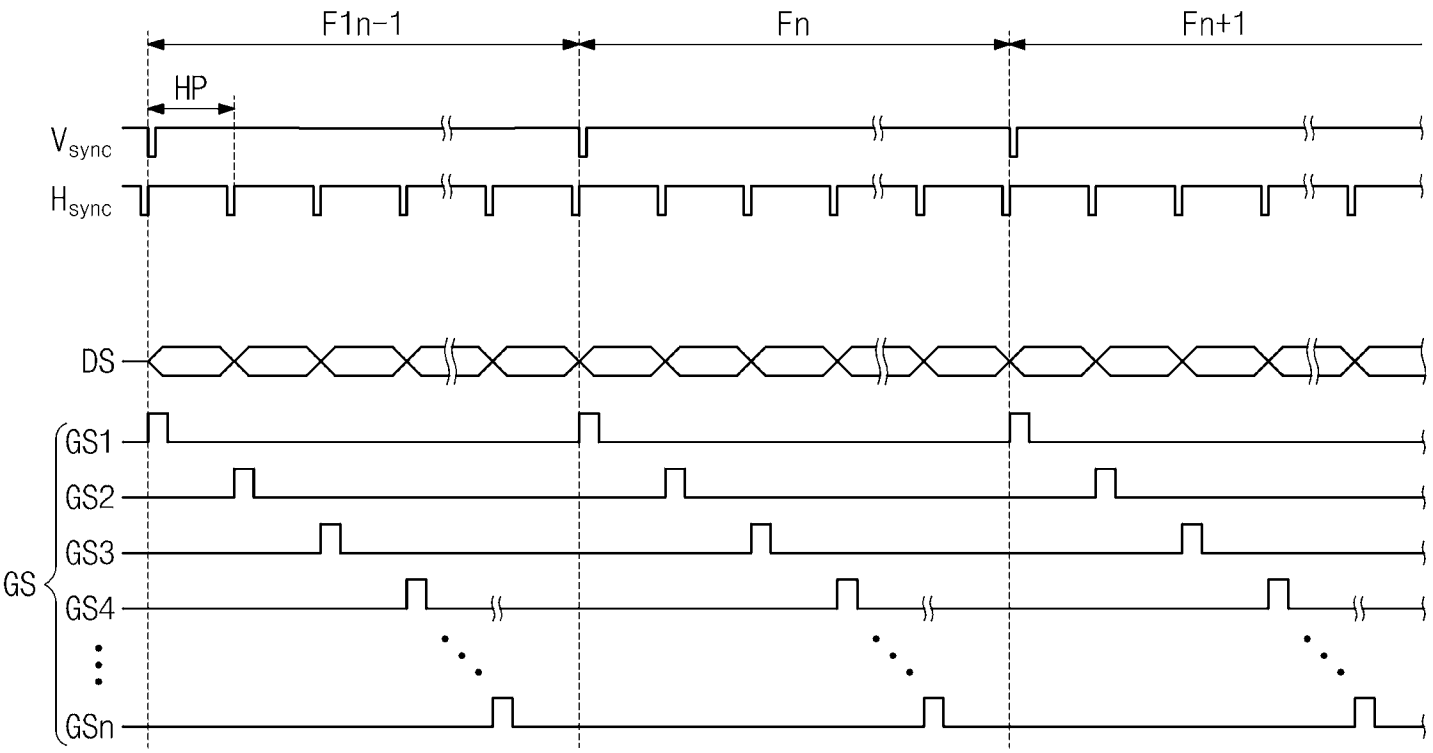
FIG. 2 is a timing diagram showing signals used in a display device according to an exemplary embodiment.

FIG. 1 is a plan view showing a display device according to an exemplary embodiment, and FIG. 2 is a timing diagram showing signals used in a display device according to an exemplary embodiment.

Referring to FIGS. 1 and 2, the display device 100 includes a display panel DP, a gate driving circuit 110, and a data driving circuit 120.

The display panel DP may be one of various types of display panels, including but not limited to, a liquid crystal display panel, an organic light emitting display panel, an electrophoretic display panel, an electrowetting display panel, and the like.

In the present exemplary embodiment, a liquid crystal display panel will be described as the display panel DP, but the display panel DP is not limited to the liquid crystal display panel. The liquid crystal display device, including the liquid crystal display panel, may further include a polarizer (not shown) and a backlight unit (not shown).

The display panel DP includes a first substrate DS1, a second substrate DS2 spaced apart from the first substrate DS1, and a liquid crystal layer (not shown) disposed between the first and second substrates DS1 and DS2. The display panel DP includes a display area DA, in which a plurality of pixels PX11 to PXnm are disposed, and a non-display area NDA surrounding the display area DA.

The display panel DP includes a plurality of gate lines GL1 to GLn and a plurality of data lines DL1 to DLm, which are disposed on the first base substrate DS1. The gate lines GL1 to GLn cross the data lines DL1 to DLm. The gate lines GL1 to GLn are connected to the gate driving circuit 110. The data lines DL1 to DLm are connected to the data driving circuit 120.

Each of the pixels PX11 to PXnm is connected to a corresponding gate line of the gate lines GL1 to GLn and a corresponding data line of the data lines DL1 to DLm. The pixels PX11 to PXnm are grouped into a plurality of groups according to colors displayed thereby. Each of the pixels PX11 to PXnm displays one of primary colors. The primary colors may include, but not limited to, a red color, a green color, a blue color, and a white color. That is, the primary colors may further include various colors, e.g., yellow, cyan, magenta, etc.

Although not shown in figures, the display panel DP may further include a dummy gate line disposed in the non-display area NDA of the first substrate DS1. The dummy gate line is not connected to the pixels PX11 to PXnm and is connected to the gate driving circuit 110.

The gate driving circuit 110 and the data driving circuit 120 receive control signals from a signal controller SC, e.g., a timing controller. The signal controller SC is mounted on a main circuit board MCB. The signal controller SC receives image signals and control signals from an external graphic controller (not shown). The control signals include a vertical synchronization signal Vsync, a horizontal synchronization signal Hsync, a data enable signal, and clock signals.

The vertical synchronization signal Vsync serves as a signal to indicate distinct frame periods Fn−1, Fn, and Fn+1. The horizontal synchronization signal Hsync serves as a row distinction signal to indicate distinct horizontal periods HP. The data enable signal DE is maintained at a high level during a period, in which data are output, to indicate a data input period. The clock signals serve as toggle signals at a predetermined period.

The gate driving circuit 110 generates gate signals GS1 to GSn in response to the control signal (hereinafter, referred to as a gate control signal) provided from the signal controller SC during the frame periods Fn−1, Fn, and Fn+1, and applies the gate signals GS1 to GSn to the gate lines GL1 to GLn. The gate signals GS1 to GSn are sequentially output to correspond to the horizontal periods HP. The gate driving circuit 110 may be substantially simultaneously formed together with the pixels PX11 to PXnm through a thin film process. For instance, the gate driving circuit 110 may be mounted on the non-display area NDA in one of an amorphous silicon TFT gate driver circuit (ASG) form or an oxide semiconductor TFT gate driver circuit (OSG) form.

Alternately, the display device 100 may include two or more gate driving circuits. One gate driving circuit of the two gate driving circuits is connected to one end of each of the gate lines GL1 to GLn, and the other gate driving circuit of the two gate driving circuits is connected to the other end of each of the gate lines GL1 to GLn. In addition, one gate driving circuit of the two gate driving circuits may be connected to odd-numbered gate lines of the gate lines GL1 to GLn and the other gate driving circuit of the two gate driving circuits may be connected to even-numbered gate lines of the gate lines GL1 to GLn.

The data driving circuit 120 generates grayscale voltages corresponding to the image data provided from the signal controller SC in response to the control signal (hereinafter, referred to as a data signal) provided from the signal controller SC. The data driving circuit 120 applies the grayscale voltages to the data lines DL1 to DLm as data voltages DS.

The data voltages DS include positive (+) data voltages having a positive polarity with respect to a common voltage and/or negative (−) data voltage having a negative polarity with respect to the common voltage. A portion of the data voltages applied to the data lines DL1 to DLm during each horizontal period HP has a positive polarity, and the other portion of the data voltages applied to the data lines DL1 to DLm during each horizontal period HP has a negative polarity. The polarity of the data voltages DS is inverted according to the frame periods Fn−1, Fn, and Fn+1 to prevent liquid crystals from burning and deteriorating. The data driving circuit 120 generates the data voltages inverted in the unit of frame period in response to an inversion signal.

The data driving circuit 120 includes a driving chip 121 and a flexible circuit board 122 on which the driving chip 121 is mounted. Each of the driving chip 121 and the flexible circuit board 122 may be provided in a plural number. The flexible circuit board 122 electrically connects the main circuit board MCB and the first substrate DS1. Each of the driving chips 121 drives a corresponding data line of the data lines DL1 to DLm. Each of the driving chips 121 applies a corresponding data voltage of the data voltages to a corresponding data line of the data lines DL1 to DLm. In an alternate embodiment, each driving chip 121 may drive at least two data lines of the data lines DL1 to DLm.

In FIG. 1, the data driving circuit 120 may be provided in a tape carrier package (TCP) form, but it should not be limited thereto or thereby. That is, the data driving circuit 120 may be mounted on the first substrate DS1 in a chip-on-glass (COG) form to correspond to the non-display area NDA.

Figure 3:
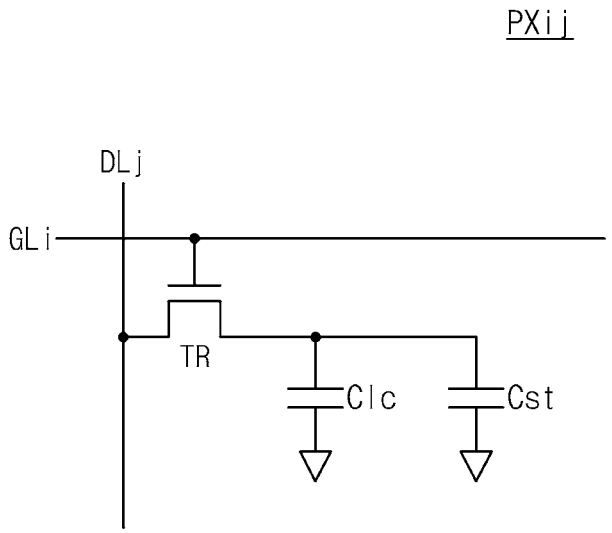
FIG. 3 is an equivalent circuit diagram showing one pixel of pixels shown in FIG. 1.
Figure 4:
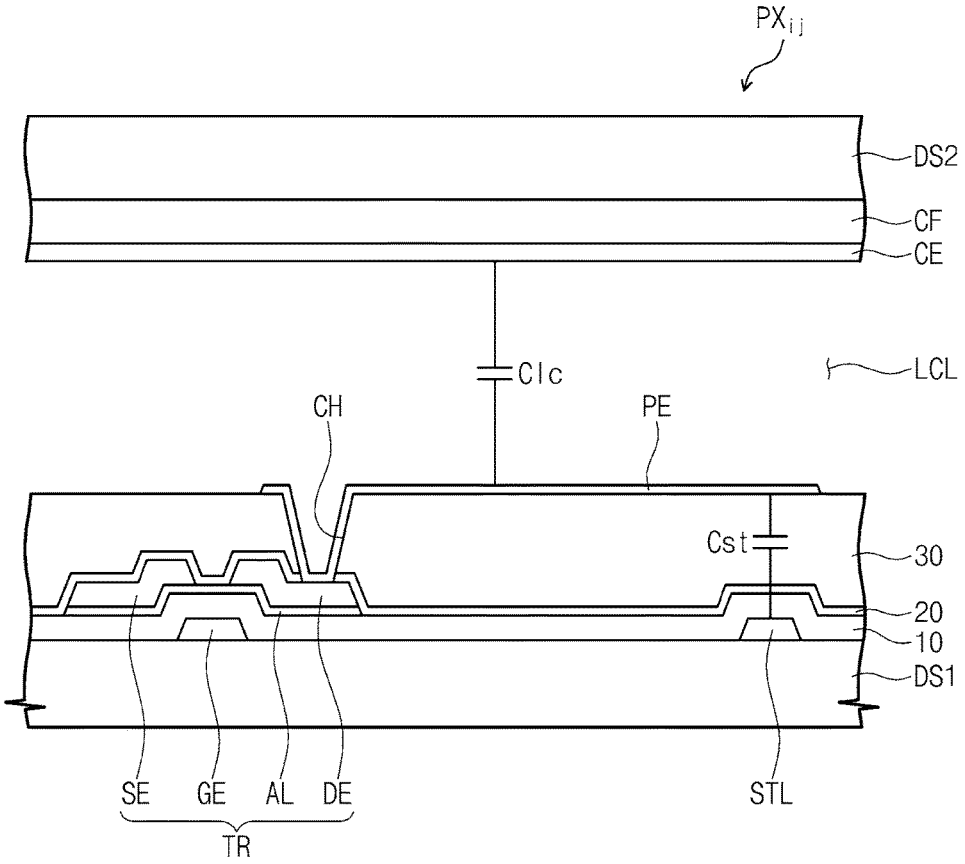
FIG. 4 is a cross-sectional view showing one pixel of pixels shown in FIG. 1.

FIG. 3 is an equivalent circuit diagram showing one pixel PXij of the pixels PX11 to PXnm shown in FIG. 1, and FIG. 4 is a cross-sectional view showing one pixel PXij of the pixels PX11 to PXnm shown in FIG. 1. Each of the pixels PX11 to PXnm shown in FIG. 1 may have substantially the same structure shown in FIGS. 3 and 4.

Referring to FIGS. 3 and 4, the pixel PXij includes a pixel thin film transistor TR (hereinafter, referred to as a pixel transistor), a liquid crystal capacitor Clc, and a storage capacitor Cst. Hereinafter, the term "transistor" as used herein means a thin film transistor, and the storage capacitor Cst may be omitted.

The pixel transistor TR is electrically connected to an i-th gate line GLi and a j-th data line DLj. The pixel transistor TR includes a control electrode electrically connected to the i-th gate line GLi and an input electrode electrically connected to the j-th data line DLj. The pixel transistor TR outputs a pixel voltage corresponding to the data signal provided from the j-th data line DLj in response to the gate signal provided from the i-th gate line GLi.

The liquid crystal capacitor Clc is electrically connected to an output electrode of the pixel transistor TR and charged with the pixel voltage output from the pixel transistor TR. An alignment of liquid crystal directors included in the liquid crystal layer LCL is changed in accordance with an amount of electric charges charged in the liquid crystal capacitor Clc. A light incident to the liquid crystal layer LCL transmits through or is blocked by the alignment of the liquid crystal directors.

The storage capacitor Cst is connected in parallel with the liquid crystal capacitor Clc. The storage capacitor Cst maintains the alignment of the liquid crystal directors for a predetermined period.

Referring to FIG. 4, the pixel transistor TR includes the control electrode GE connected to the i-th gate line GLi, an active part AL overlapped with the control electrode GE, the input electrode SE connected to the j-th data line DLj, and the output electrode DE spaced apart from the input electrode SE.

The liquid crystal capacitor Clc includes a pixel electrode PE and a common electrode CE. The storage capacitor Cst includes the pixel electrode PE and a portion of a storage line STL.

The i-th gate line GLi and the storage line STL are disposed on an upper surface of the first substrate DS1. The control electrode GE is branched from the i-th gate line GLi. The i-th gate line GLi and the storage line STL include a metal material, such as aluminum (Al), silver (Ag), copper (Cu), molybdenum (Mo), chromium (Cr), tantalum (Ta), titanium (Ti), or an alloy thereof. Each of the i-th gate line GLi and the storage line STL has a multi-layer structure of a titanium layer and a copper layer.

A first insulating layer 10 is disposed on the first substrate DS1 to cover the control electrode GE and the storage line STL. The first insulating layer 10 includes at least one of an inorganic material and an organic material. The first insulating layer 10 is an organic or inorganic layer. The first insulating layer 10 has a multi-layer structure of a silicon nitride layer and a silicon oxide layer.

The active part AL is disposed on the first insulating layer 10 to overlap with the control electrode GE. The active part AL includes a semiconductor layer and an ohmic contact layer. The semiconductor layer is disposed on the first insulating layer 10, and the ohmic contact layer is disposed on the semiconductor layer.

The semiconductor layer includes amorphous silicon or polysilicon. In addition, the semiconductor layer may include a metal oxide semiconductor. The ohmic contact layer is highly doped with a dopant than the semiconductor layer. The ohmic contact layer may include two portions spaced apart from each other. In the present exemplary embodiment, the ohmic contact layer may be integrally formed in a single unitary and individual unit.

The output electrode DE and the input electrode SE are disposed on the active part AL. The output electrode DE and the input electrode SE are spaced apart from each other. Each of the output electrode DE and the input electrode SE is partially overlapped with the control electrode GE.

In detail, the output electrode DE and the input electrode SE are disposed on the active part AL. When viewed in a plan view, the output electrode DE is completely overlapped with one portion of the active part AL and the input electrode SE is completely overlapped with the other portion of the active part AL.

A second insulating layer 20 is disposed on the first insulating layer 10 to cover the active part AL, the output electrode DE, and the input electrode SE. The second insulating layer 20 includes an inorganic or organic material. The second insulating layer 20 is an organic or inorganic layer. The second insulating layer 20 has a multi-layer structure of a silicon nitride layer and a silicon oxide layer.

FIG. 4 shows the pixel transistor TR having a staggered structure, but the structure of the pixel transistor TR should not be limited to the staggered structure. That is, the pixel transistor TR may have a planar structure.

A third insulating layer 30 is disposed on the second insulating layer 20. The third insulating layer 30 provides a level surface. The third insulating layer 30 includes an organic material.

The pixel electrode PE is disposed on the third insulating layer 30. The pixel electrode PE is connected to the output electrode DE through a contact hole CH formed through the second and third insulating layer 20 and 30. An alignment layer (not shown) may be disposed on the third insulating layer 20 to cover the pixel electrode PE.

A color filter layer CF is disposed on a surface of the second substrate DS2. The common electrode CE is disposed on the color filter layer CF. The common electrode CE is applied with a common voltage. The common voltage has a level different from that of the pixel voltage. An alignment layer (not shown) may be disposed on the common electrode CE to cover the common electrode CE. Another insulating layer may be disposed between the color filter layer CF and the common electrode CE.

The pixel electrode PE and the common electrode CE, which face each other such that the liquid crystal layer LCL is disposed between the pixel electrode PE and the common electrode CE, form the liquid crystal capacitor Clc. In addition, the pixel electrode PE and the portion of the storage line STL, which face each other such that the first, second, and third insulating layers 10, 20, and 30 are disposed between the pixel electrode PE and the portion of the storage line STL, form the storage capacitor Cst. The storage line STL is applied with a storage voltage having a level different from that of the pixel voltage. The storage voltage may have the same level as that of the common voltage.

Meanwhile, alternate to the structure of the pixel PXij shown in FIG. 4, at least one of the color filter layer CF and the common electrode CE may be disposed on the first substrate DS1. In other words, the liquid crystal display panel according to the present exemplary embodiment may include a vertical alignment (VA) mode pixel, a patterned vertical alignment (PVA) mode pixel, an in-plane switching (IPS) mode pixel, a fringe-field switching (FFS) mode pixel, or a plane-to-line switching (PLS) mode pixel.

Figure 5:
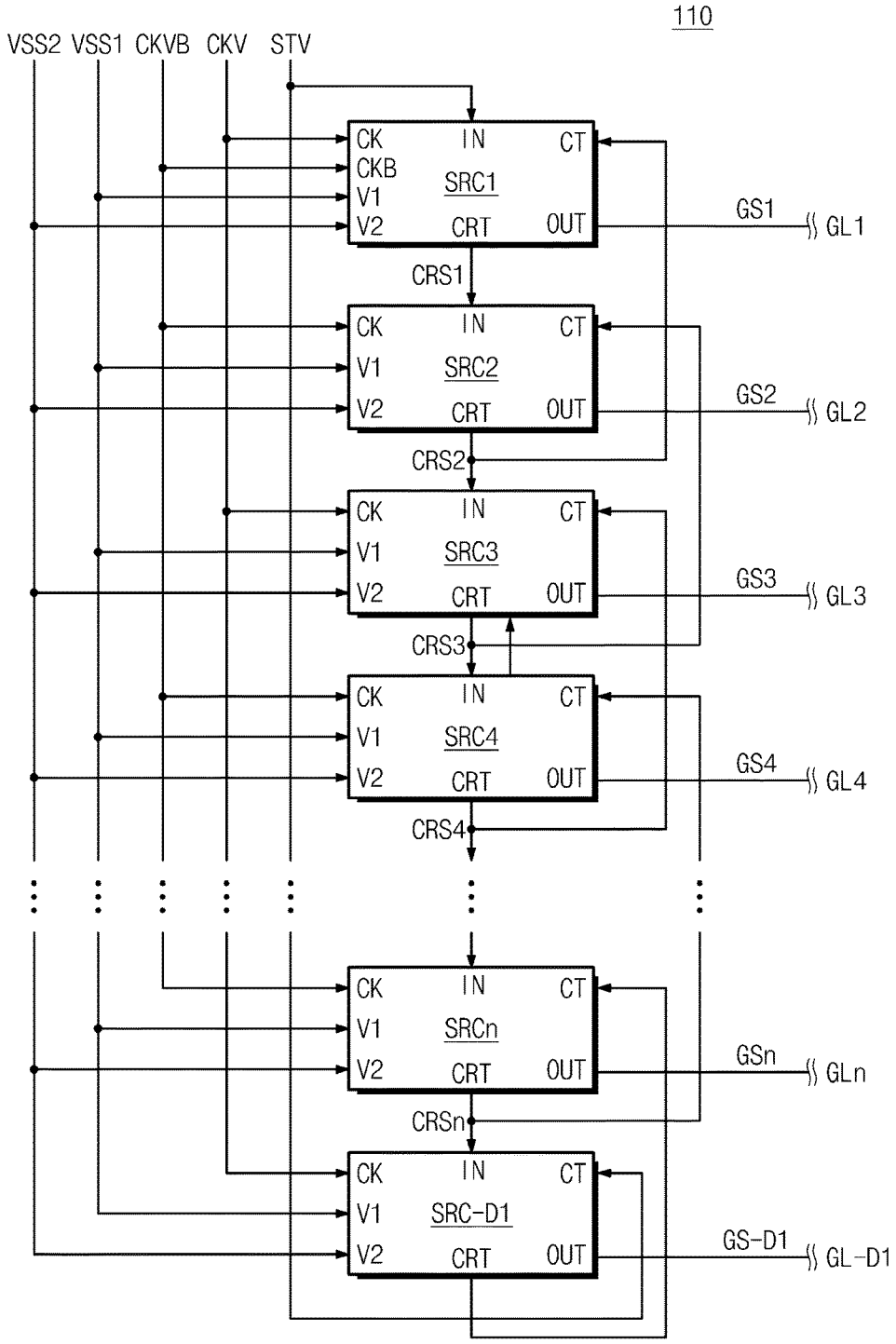
FIG. 5 is a block diagram showing a gate driving circuit shown in FIG. 1.

FIG. 5 is a block diagram showing the gate driving circuit shown in FIG. 1. Referring to FIG. 5, the gate driving circuit 110 includes a plurality of driving stages SRC1 to SRCn connected to each other one after another. Hereinafter, for the convenience of explanation, a first driving stage SRC1 corresponds to a first driving stage of the driving stages SRC1 to SRCn, and the first to n-th driving stages are sequentially connected to each other in series, but they should not be limited thereto or thereby.

The driving stages SRC1 to SRCn are respectively connected to the gate lines GL1 to GLn. The driving stages SRC1 to SRCn apply the gate signals to the gate lines GL1 to GLn, respectively. In the present exemplary embodiment, the gate lines connected to the driving stages SRC1 to SRCn may be odd-numbered gate lines and even-numbered gate lines among the gate lines GL1 to GLn.

The gate driving circuit 110 may further include a dummy stage SRC-D1 connected to a last driving stage SRCn among the driving stages SRC1 to SRCn. The dummy stage SRC-D1 is connected to a dummy gate line GL-D1. The number of the dummy stages SRC-D1 may be increased or decreased. When the number of the dummy stages SRC-D1 is changed, the number of the dummy gate lines GL-D1 is changed. The dummy stages SRC-D1 may have substantially the same structure as or a different structure from the driving stages SRC1 to SRCn.

Each of the driving stages SRC1 to SRCn includes an output terminal OUT, a carry terminal CRT, an input terminal IN, a clock terminal CK, a first voltage input terminal V1, a second voltage input terminal V2, and a control terminal CT.

The output terminal OUT of each of the driving stages SRC1 to SRCn is connected to a corresponding gate line of the gate lines GL1 to GLn. The gate signals GS1 to GSn generated by the driving stages SRC1 to SRCn are applied to the gate lines GL1 to GLn through the output terminals OUT.

The carry terminal CRT of each of the driving stages SRC1 to SRCn is electrically connected to the input terminal IN of a next driving stage following the corresponding driving stage. For instance, the carry terminal CRT of a third driving stage SRC3 is electrically connected to the input terminal IN of a fourth driving stage SRC4 right following the third driving stage SRC3. The carry terminals CRT of the driving stages SRC1 to SRCn outputs carry signals CRS1 to CRSn, respectively.

The input terminal IN of each of the driving stages SRC1 to SRCn receives the carry signal from a previous driving stage prior to the corresponding driving stage. For instance, the input terminal IN of the third driving stage SRC3 receives the carry signal CRS2 output from a second driving stage SRC2. Among the driving stages SRC1 to SRCn, the input terminal IN of the first driving stage SRC1 receives a start signal STV that starts an operation of the gate driving circuit 110.

The control terminal CT of each of the driving stages SRC1 to SRCn receives the carry signal of the next driving stage following the corresponding driving stage. For instance, the control terminal CT of the third driving stage SRC3 receives a fourth carry signal CRS4 output from the fourth driving stage SRC4. The control terminal CT of the dummy stage SRC-D1 receives the start signal STV.

The clock terminal CK of each of the driving stages SRC1 to SRCn receives a first clock signal CKV or a second clock signal CKVB. The clock terminals CK of the odd-numbered driving stages SRC1, SRC3, and SRC5 among the driving stages SRC1 to SRCn receive the first clock signal CKV. The clock terminals CK of the even-numbered driving stages SRC2, SRC4, and SRCn among the driving stages SRC1 to SRCn receive the second clock signal CKVB. The first and second clock signals CKV and CKVB have different phases from each other. The second clock signal CKVB is obtained by inverting the first clock signal CKV.

The first voltage input terminal V1 of each of the driving stages SRC1 to SRCn receives a first discharge voltage VSS1 and the second voltage input terminal V2 of each of the driving stages SRC1 to SRCn receives a second discharge voltage VSS2. In the present exemplary embodiment, the second discharge voltage VSS2 may have the voltage level lower than that of the first discharge voltage VSS1.

In each of the driving stages SRC1 to SRCn according to the present exemplary embodiment, one of the output terminal OUT, the input terminal IN, the carry terminal CRT, the control terminal CT, the clock terminal CK, the first voltage input terminal V1, and the second voltage input terminal V2 may be omitted or another terminal may be added to each of the driving stages SRC1 to SRCn. For instance, one of the first and second voltage input terminals V1 and V2 may be omitted. In addition, a connection relation between the driving stages SRC1 to SRCn may be changed.

In the present exemplary embodiment, the first driving stage SRC1 has a structure different from the other driving stages SRC2 to SRCn. In detail, each of the second to n-th driving stages SRC2 to SRCn receives the carry signal from the previous driving stage through the input terminal thereof, but the first driving stage SRC1 receives the start signal STV through the input terminal IN thereof. In addition, each of the second to n-th driving stages SRC2 to SRCn receives one of the first and second clock signals CKV and CKVB through the clock terminal CK thereof, but the first driving stage SRC1 further includes a clock bar terminal CKB. The first driving stage SRC1 receives the first clock signal CKV and the second clock signal CKVB respectively through the clock terminal CK and the clock bar terminal CKB.

The start signal STV serves as a signal indicating the start of the operation of the gate driving circuit 110 and is provided from the signal controller SC.

The first driving stage SRC1 generates the first carry signal CRS1 and the first gate signal GS1 in response to the first clock signal CKV and precharges a first node NQ with the second clock signal CKVB to generate the first carry signal CRS1 and the first gate signal GS1. The structure and function of the first driving stage SRC1 will be described in detail later.

Figure 6:
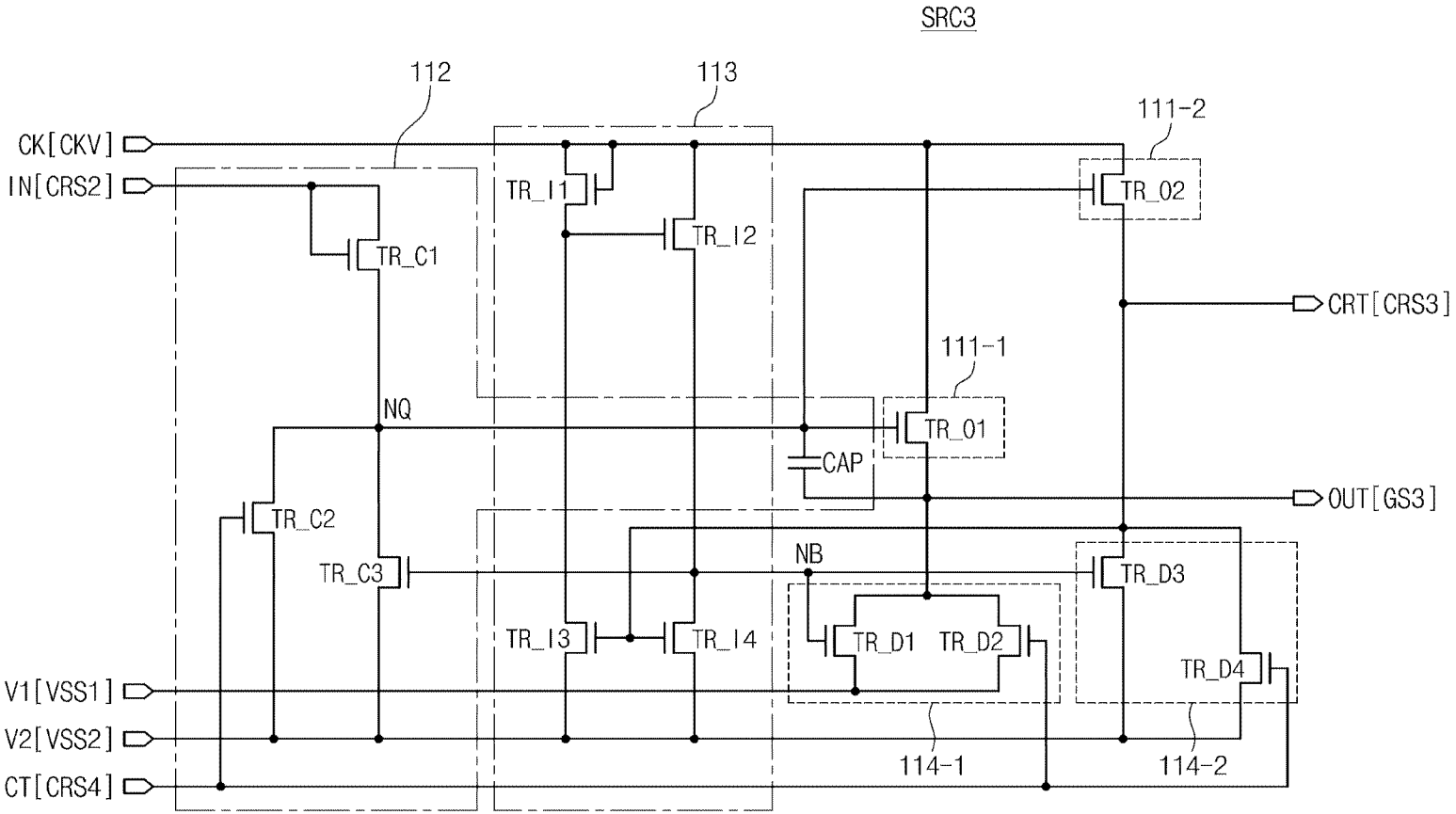
FIG. 6 is a circuit diagram showing a third driving stage of driving stages shown in FIG. 5.

FIG. 6 is a circuit diagram showing the third driving stage SRC3 of the driving stages SRC1 to SRCn shown in FIG. 5. Hereinafter, the third driving stage SRC3 will be described in detail with reference to FIG. 6 as a representative example, but the other driving stages may have substantially the same circuit diagram as that of the third driving stage SRC3.

Referring to FIG. 6, the third driving stage SRC3 includes output parts 111-1 and 111-2, a control part 112, an inverter part 113, and pull-down parts 114-1 and 114-2. The output parts 111-1 and 111-2 include a first output part 111-1 outputting a third gate signal GS3, and a second output part 111-2 outputting a third carry signal CRS3. The pull-down parts 114-1 and 114-2 include a first pull-down part 114-1 lowering the output terminal OUT and a second pull-down part 114-2 lowering the carry terminal CRT. The circuit configuration of the third driving stage SRC3 should not be limited to the above-mentioned circuit configuration.

The first output part 111-1 includes a first output transistor TR_O1. The first output transistor TR_O1 includes an input electrode applied with the first clock signal CKV, a control electrode connected to a first node NQ (or control node), and an output electrode outputting the third gate signal GS3.

The second output part 111-2 includes a second output transistor TR2_O2. The second output transistor TR_O2 includes an input electrode applied with the first clock signal CKV, a control electrode connected to the first node NQ, and an output electrode outputting the third carry signal CRS3. The second output transistor TR_O2 outputs the third carry signal CRS3 on the basis of the clock signal CKV in response to a voltage of the first node NQ.

The control part 112 controls an operation of the first and second output parts 111-1 and 111-2. The control part 112 receives the second carry signal CRS2 output from the second driving stage SRC2, i.e., the previous driving stage, through the input terminal IN thereof. The control part 112 turns on the first and second output parts 111-1 and 111-2 in response to the second carry signal CRS2 provided through the control terminal IN. The control part 112 turns off the first and second output parts 111-1 and 111-2 in response to the fourth carry signal CRS4 output from the fourth driving stage SRC4, i.e., the next driving stage. The control part 112 maintains the turned-off state of the first and second output parts 111-1 and 111-2 in response to the switching signal.

The control part 112 includes a first control transistor TR_C1, a second control transistor TR_C2, a third control transistor TR_C3, and a capacitor CAP.

The first control transistor TR_C1 includes an output electrode connected to the first node NQ, and a control electrode and an input electrode, which are commonly connected to the input terminal IN. The first control transistor TR_C1 is diode-connected between the input terminal IN and the first node NQ such that a current path is formed between the input terminal IN and the first node NQ. The first control transistor TR_C1 applies a signal from the input terminal IN, i.e., the second carry signal CRS2, to the first node NQ. The first node NQ has an electric potential increasing by the second carry signal CRS2 provided from the first control transistor TR_C1.

The capacitor CAP is connected between the control electrode and the output electrode of the first output transistor TR_O1 of the first output part 111-1 and provided between the output terminal OUT and the first node NQ.

The second control transistor TR_C2 is provided between the second voltage input terminal V2 and the first node NQ. The second control transistor TR_C2 includes a control electrode connected to the control terminal CT. The second control transistor TR_C2 applies the second discharge voltage VSS2 to the first node NQ in response to the fourth carry signal CRS4 provided from the control terminal CT.

The third control transistor TR_C3 is connected between the second voltage input terminal V2 and the first node NQ. A control electrode of the third control transistor TR_C3 is connected to a second node NB, i.e., an output node. The second node NB is connected to an output terminal of the inverter part 130. The third control transistor TR_C1 applies the second discharge voltage VSS2 to the first node NQ in response to the switching signal provided from the inverter part 130.

In the present exemplary embodiment, the number of each of the second and third control transistors TR_C2 and TR_C3 may be increased. When the number of each of the second and third control transistors TR_C2 and TR_C3 is increased, the second control transistors TR_C2 are connected to each other in series and the third control transistors TR_C3 are connected to each other in series. In addition, one of the second and third control transistors TR_C2 and TR_C3 may be connected to the first voltage input terminal V1 instead of the second voltage input terminal V2.

Referring to FIG. 6, the inverter part 113 outputs the switching signal of the second node NB. The inverter part 113 includes first, second, third, and fourth inverter transistors TR_I1, TR_I2, TR_I3, and TR_I4. The first inverter transistor TR_I1 includes an input electrode and a control electrode, which are commonly connected to the clock terminal CK, and an output electrode connected to a control electrode of the second inverter transistor TR_I2. The second inverter transistor TR_I2 includes an input electrode connected to the clock terminal CK and an output electrode connected to the second node NB.

The third inverter transistor TR_I3 includes an output electrode connected to the output electrode of the first inverter transistor TR_I1, a control electrode connected to the carry terminal CRT, and an input electrode connected to the second voltage input terminal V2. The fourth inverter transistor TR_I4 includes an output electrode connected to a third node NC, i.e., a gate node, a control electrode connected to the carry terminal CRT, and an input electrode connected to the second voltage input terminal V2. Alternately, the control electrodes of the third and fourth inverter transistors TR_I3 and TR_I4 may be connected to the output terminal OUT and the output electrodes of the third and fourth inverter transistors TR_I3 and TR_I4 may be connected to the first voltage input terminal V1.

The first pull-down part 114-1 includes a first pull-down transistor TR_D1 and a second pull-down transistor TR_D2. The first pull-down transistor TR_D1 includes an input electrode connected to the first voltage input terminal V1, a control electrode connected to the second node NB, and an output electrode connected to the output terminal OUT. The second pull-down transistor TR_D2 includes an input electrode connected to the first voltage input terminal V1, a control electrode connected to the control terminal CT, and an output electrode connected to the output terminal OUT. Alternately, at least one of the input electrode of the first pull-down transistor TR_D1 and the input electrode of the second pull-down transistor TR_D2 may be connected to the second voltage input terminal V2.

The second pull-down part 114-2 includes a third pull-down transistor TR_D3 and a fourth pull-down transistor TR_D4. The third pull-down transistor TR_D3 includes an input electrode connected to the second voltage input terminal V2, a control electrode connected to the second node NB, and an output electrode connected to the carry terminal CRT. The fourth pull-down transistor TR_D4 includes an input electrode connected to the second voltage input terminal V2, a control electrode connected to the control terminal CT, and an output electrode connected to the carry terminal CRT. Alternately, at least one of the input electrode of the third pull-down transistor TR_D3 and the input electrode of the fourth pull-down transistor TR_D4 may be connected to the first voltage input terminal V1.

Figure 7:
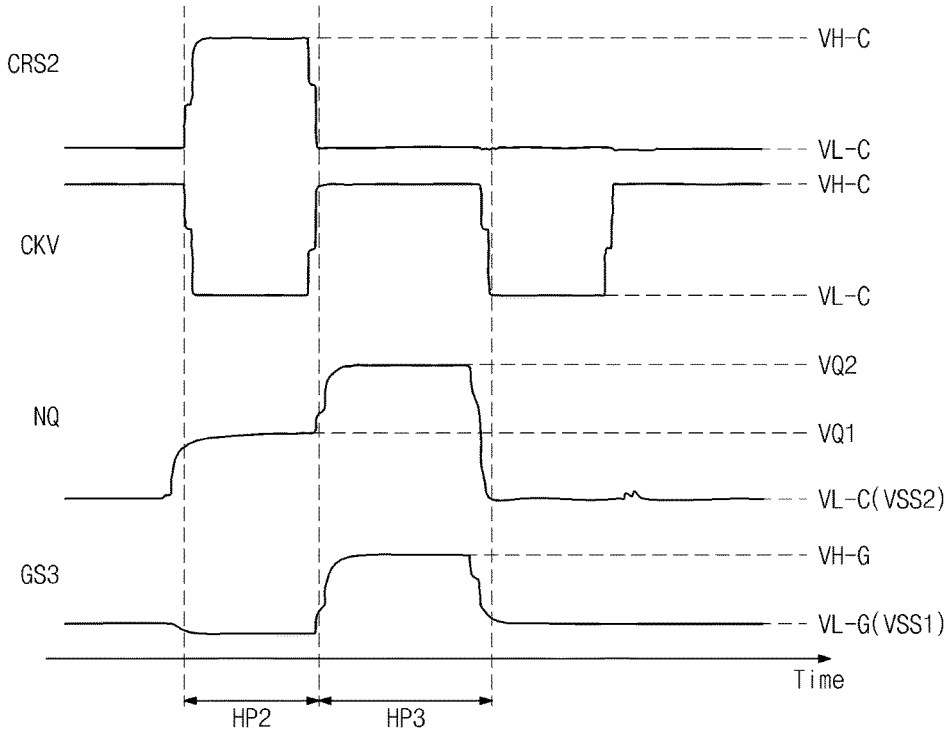
FIG. 7 is a waveform diagram showing input and output signals of the third driving stage shown in FIG. 6.

FIG. 7 is a waveform diagram showing input and output signals of the third driving stage SRC3 shown in FIG. 6.

Referring to FIGS. 6 and 7, the third driving stage SRC3 receives the second carry signal CRS2 from the second driving stage SRC2 through the input terminal IN. The second carry signal CRS2 may be a high voltage VH-C during a second horizontal period HP2. The first control transistor TR_C1 of the third driving stage SRC3 applies the second carry signal CRS2 having the high voltage VH-C to the first node NQ during the second horizontal period HP2. In this case, the first node NQ is precharged to a first voltage VQ1. In the present exemplary embodiment, the first voltage VQ1 may be lower than the high voltage VH-C of the second carry signal CRS2 by a predetermined level. The high voltage VH-C is about 10 volts and a low voltage VL-C is about −16 volts. The low voltage VL-C has substantially the same level as that of the second discharge voltage VSS2.

Then, the second carry signal CRS2 decreases to the low voltage VL-C and the first clock signal CKV increases to the high voltage VH-C during the third horizontal period HP3. Since the first node NQ is precharged to the first voltage VQ1 in the second horizontal period HP2, the first and second output transistors TR_O1 and TR_O2 of the third driving stage SRC3 are in the turn-on state. When the first clock signal CKV increases to the high voltage VH-C during the third horizontal period HP3, the first node NQ of the third driving stage SRC3 is charged with the second voltage VQ2, and thus the first and second output transistors TR_O1 and TR_O2 output the third gate signal GS3 and the third carry signal CRS3, respectively.

After that, the first clock signal CKV decreases to the low voltage VL-C and the fourth carry signal CRS4 increases to the high voltage VH-C during the fourth horizontal period HP4. The inverter part 113 of the third driving stage SRC3 outputs a signal obtained by inverting the first clock signal CKV as a switching signal of the second node NB during the fourth horizontal period HP4. The first and second pull-down parts 114-1 and 114-2 of the third driving stage SRC3 decreases the third gate signal GS3 and the third carry signal CRS3 to the low voltage VL-C during the fourth horizontal period HP4 in response to the switching signal of the second node NB and the fourth carry signal CRS4.

Through the above-mentioned operation, the other driving stages SRC2 and SRC4 to SRCn output the gate signal and the carry signal.

Figure 8:
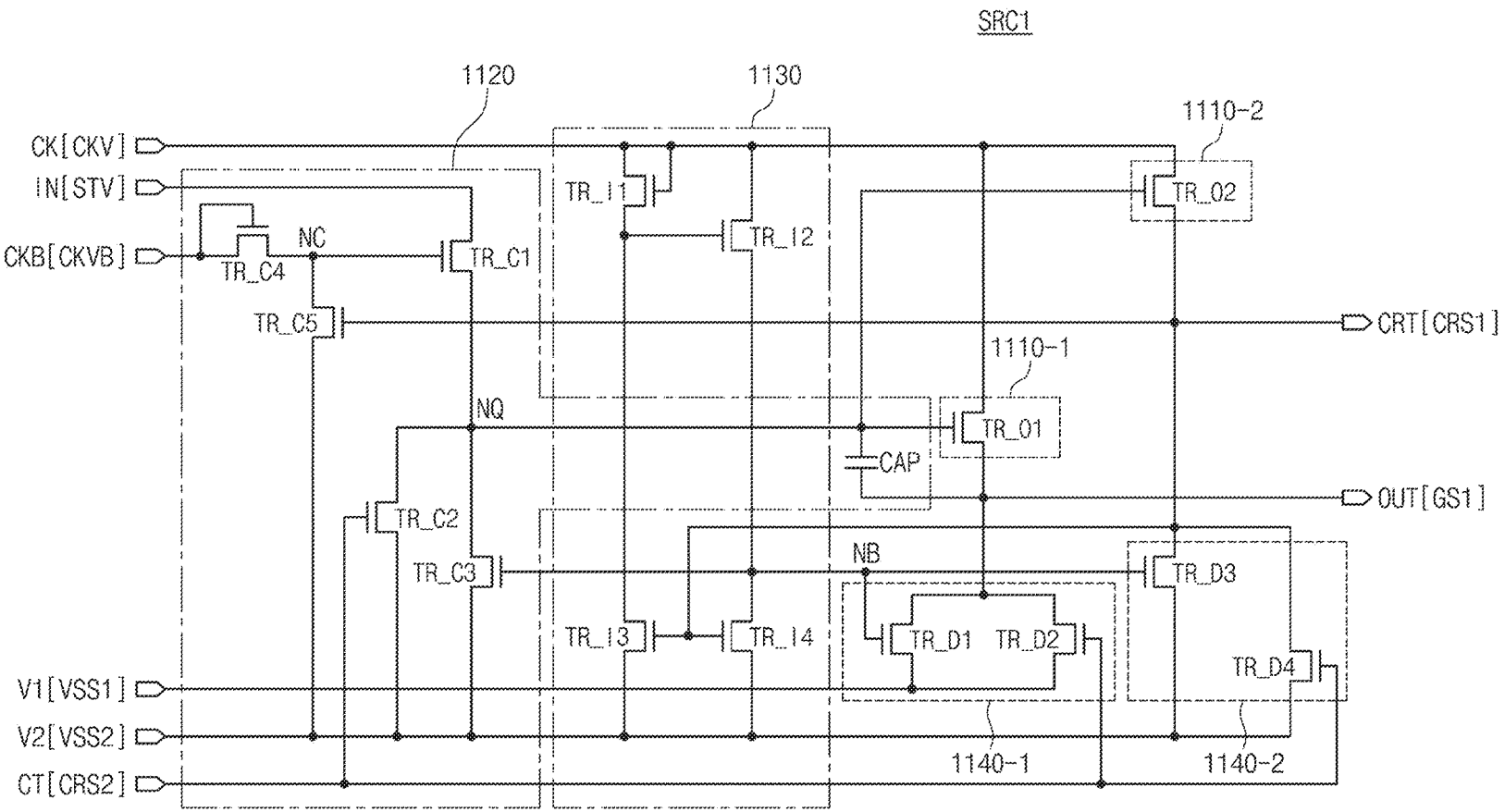
FIG. 8 is a circuit diagram showing a first driving stage of driving stages shown in FIG. 5.

FIG. 8 is a circuit diagram showing the first driving stage SRC1 of the driving stages SRC1 to SRCn shown in FIG. 5. Among the driving stages SRC1 to SRCn, the other driving stages SRC2 to SRCn, except for the first driving stage SRC1, may have substantially the same structure of the third driving stage SRC3.

However, the first driving stage SRC1 according to the present exemplary embodiment has a structure different from that of the third driving stage SRC3 shown in FIG. 6. Hereinafter, different features of the first driving stage SRC1 from those of the third driving stage SRC3 will be mainly described.

Referring to FIG. 8, the first driving stage SRC1 includes output parts 1110-1 and 1110-2, a control part 1120, an inverter part 1130, and pull-down parts 1140-1 and 1140-2. The output parts 1110-1 and 1110-2 include first and second output transistors TR_O1 and TR_O2. The inverter part 1130 includes first to fourth inverter transistors TR_I1 to TR_I4. The pull-down parts 1140-1 and 1140-2 include first to fourth pull-down transistors TR_D1 to TR_D4. The output parts 1110-1 and 1110-2, the inverter part 1130, and the pull-down parts 1140-1 and 1140-2 have the same structure and function as those of the output parts 111-1 and 111-2, the inverter part 113, and the pull-down parts 114-1 and 114-2 of the third driving stage SRC3 shown in FIG. 6, and thus, details thereof will be omitted.

The control part 1120 includes first to fifth control transistors TR_C1 to TR_C5. The first control transistor TR_C1 includes an input electrode connected to the input terminal IN, a control electrode connected to the third node NC, and an output electrode connected to the first node NQ. The first control transistor TR_C1 applies a signal provided from the input terminal IN to the first node NQ in response to a voltage of the third node NC. The first node NQ is precharged to the first voltage VQ1 by the signal provided through the first control transistor TR_C1. The first driving stage SRC1 receives the start signal STV through the input terminal thereof. That is, the first control transistor TR_C1 applies the start signal STV to the first node NQ.

The second and third control transistors TR_C2 and TR_C3 are operated in the above-mentioned operation in FIG. 6, and thus details thereof will be omitted.

The fourth control transistor TR_C4 includes an output electrode connected to the second node NB and input and control electrodes commonly connected to the inverting clock terminal CKB. The fourth control transistor TR_C4 is diode-connected between the inverting clock terminal CKB and the third node NC such that a current path is formed between the inverting clock terminal CKB and the third node NC. Accordingly, the first control transistor TR_C1 is operated in response to the second clock signal CKVB provided through the inverting clock terminal CKB.

The fifth control transistor TR_C5 includes an input electrode connected to the second voltage input terminal V2, a control electrode connected to the carry terminal CRT, and an output electrode connected to the third node NC. The fifth control transistor TR_C5 applies the second discharge voltage VSS2 provided from the second voltage input terminal V2 to the third node NC in response to the first carry signal CRS1.

According to a conventional gate driving circuit, a first driving stage may be substantially the same structure as the third driving stage SRC3 shown in FIG. 6. In this case, when the start signal STV is delayed by a predetermined time, the first node NQ is not sufficiently precharged. In other words, when the start signal STV is delayed, the precharging time of the first node NQ is reduced, so that the first node NQ is not precharged to the first voltage VQ1. Therefore, the characteristic of the first gate signal output from the output part is degraded.

The first control transistor TR_C1 of the first driving stage SRC1 included in the gate driving circuit 110 according to the present exemplary embodiment applies the start signal STV to the first node NQ in response to the second clock signal CKVB. Thus, although the precharging time for the first node NQ is reduced, the voltage of the first node NQ may be increased to the first voltage VQ1.

Figure 9:
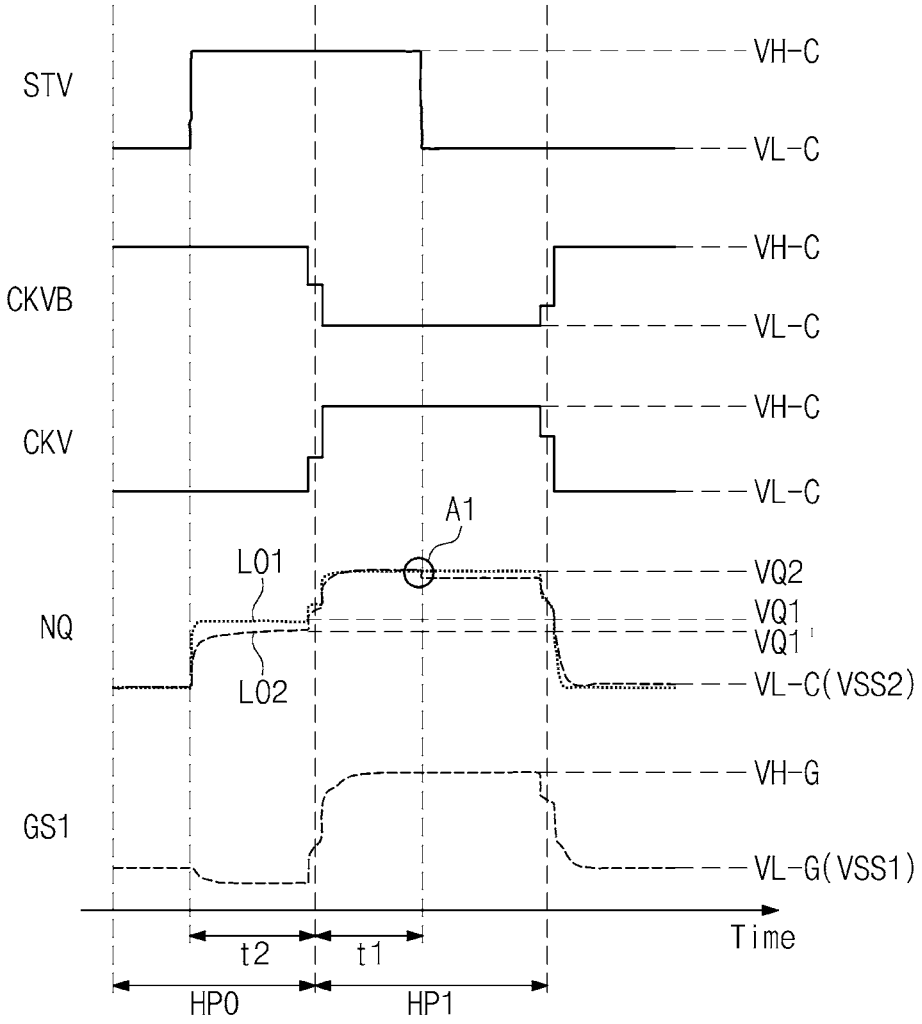
FIG. 9 is a waveform diagram showing an operation of the first driving stage shown in FIG. 8.

FIG. 9 is a waveform diagram showing an operation of the first driving stage SRC1 shown in FIG. 8. In an ideal case, the start signal STV maintains the high voltage VH-C during the 0-th horizontal period HP0. To explain the characteristic of the gate driving circuit according to the present exemplary embodiment, it is assumed that the start signal STV is delayed by a first time period t1. That is, the period in which the start signal STV maintains the high voltage VH-C overlaps with a portion of the 0-th horizontal period HP0 and a portion of the first horizontal period HP1. The horizontal periods are defined as viewed relative to one frame period, and the 0-th horizontal period corresponds to a first horizontal period of each frame period.

As an example, a first line L01 indicates the voltage of the first node NQ in the first driving stage SRC1 and a second line L02 indicates the voltage of the first node of the first driving stage in the conventional gate driving circuit.

Referring to FIGS. 8 and 9, the precharging time of the first node NQ of the first driving stage SRC1 corresponds to the 0-th horizontal period HP0 in the ideal case. However, when the start signal STV is delayed by the first time period t1, the precharging time period of the first node of the first driving stage SRC1 is shortened to a second time period t2. That is, when the start signal STV is delayed by the first time period t1, the precharging time of the first node NQ of the first driving stage SRC1 is reduced.

As described above, the first driving stage of the conventional gate driving circuit may have substantially the same structure as that of the third driving stage SRC3 shown in FIG. 6. In this case, the voltage of the first node may be precharged to a voltage VQ1' lower than the first voltage VQ1 due to the control transistor diode-connected between the input terminal and the first node NQ in the first driving stage of the conventional gate driving circuit as represented by the second line L02.

However, since the first control transistor TR_C1 of the first driving stage SRC1 according to the present exemplary embodiment is operated in response to the second clock signal CKVB and applies the start signal STV to the first node NQ, the voltage of the first node NQ may be precharged to the first voltage VQ1 during the second time period t2 as represented by the first line L01. That is, the voltage of the first node NQ is sufficiently precharged to the first voltage VQ1, and thus the output waveform of the first gate signal GS1 according to the clock signal CKV is improved.

Then, the start signal STV decreases to the low voltage VL-C in the first horizontal period HP1. In this case, the start signal STV may decrease to the low voltage VL-C in the first horizontal period HP1. Since the control transistor of the first driving stage of the conventional gate driving circuit is diode-connected between the input terminal and the first node, the voltage of the first node NQ is decreased due to the start signal STV decreasing to the low voltage VL-C as represented by a first area A1 shown in FIG. 9.

However, the first control transistor TR_C1 of the first driving stage SRC1 according to the present exemplary embodiment is operated by the second clock signal CKVB, and thus the first control transistor TR_C1 is maintained in the turned-off state during the second horizontal period HP2. That is, since the first control transistor TR_C1 applying the start signal STV to the first node NQ is maintained in the turned-off state during the first horizontal period HP1, the voltage of the first node NQ is maintained at a constant level even though the start signal STV decreases to the low voltage VL-C. Thus, coupling between the start signal STV and the first node NQ is prevented from occurring.

As described above, although the precharging time is shortened due to the delay of the start signal STV, the first driving stage SRC1 of the gate driving circuit 110 according to the present exemplary embodiment may precharge the voltage of the first node NQ to the first voltage VQ1 and prevent the coupling between the start signal STV and the first node NQ, which occurs at the time point at which the start signal STV decreases, from occurring. Accordingly, the capability and the reliability of the gate driving circuit 110 may be improved.

Figure 10:
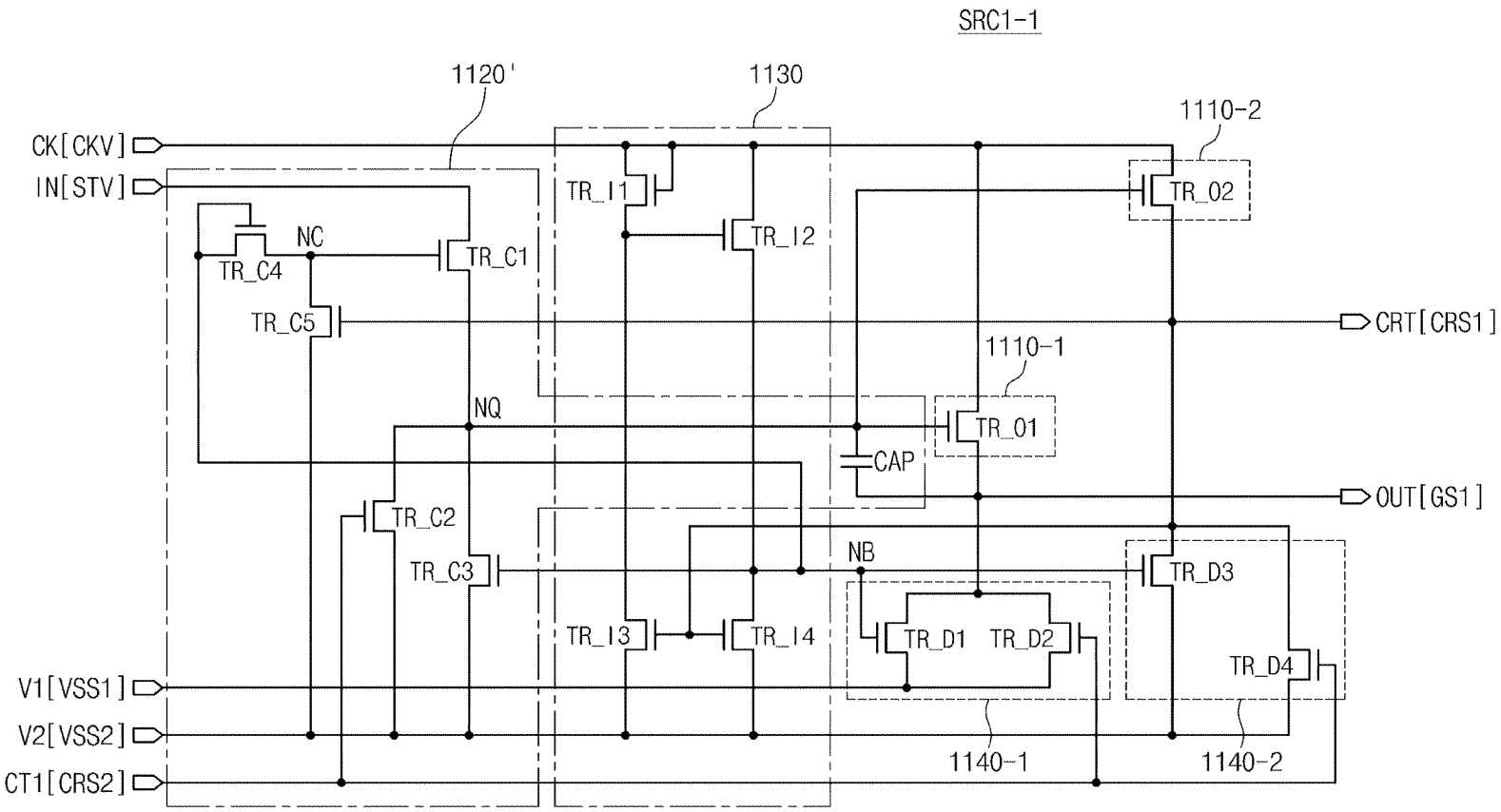
FIG. 10 is a circuit diagram showing a first driving stage according to another exemplary embodiment.

FIG. 10 is a circuit diagram showing a first driving stage SRC1-1 according to another exemplary embodiment of the present disclosure. Referring to FIG. 10, the first driving stage SRC1-1 includes output parts 1110-1 and 1110-2, a control part 1120', an inverter part 1130, and pull-down parts 1140-1 and 1140-2. The output parts 1110-1 and 1110-2 include first and second output transistors TR_O1 and TR_O2. The control part 1120' includes first to fifth control transistors TR_C1 to TR_C5. The inverter part 1130 includes first to fourth inverter transistor TR_I1 to TR_I4. The pull-down parts 1140-1 and 1140-2 include first to fourth pull-down transistors TR_D1 to TR_D4. The output parts 1110-1 and 1110-2, the inverter part 1130, and the pull-down parts 1140-1 and 1140-2 have the same structure and function as those of the output parts 111-1 and 111-2, the inverter part 113, and the pull-down parts 114-1 and 114-2 of the third driving stage SRC3 shown in FIG. 6, and thus details thereof will be omitted.

Different from the first driving stage SRC1 shown in FIG. 8, the first driving stage SRC1-1 shown in FIG. 10 does not receive the second clock signal CKVB. The input electrode of the fourth control transistor TR_C4 of the first driving stage SRC1-1 is connected to the second node NB. That is, the switching signal of the second node NB, which is output from the inverter part 1130, may be synchronized with the first clock signal CKV and substantially the same as the first clock signal CKV except for the first horizontal period HP1. In other words, the first driving stage SRC1-1 is operated in response to the switching signal of the second node NB, i.e., the output signal of the inverter part 1130, instead of the second clock signal CKVB.

Figure 11:
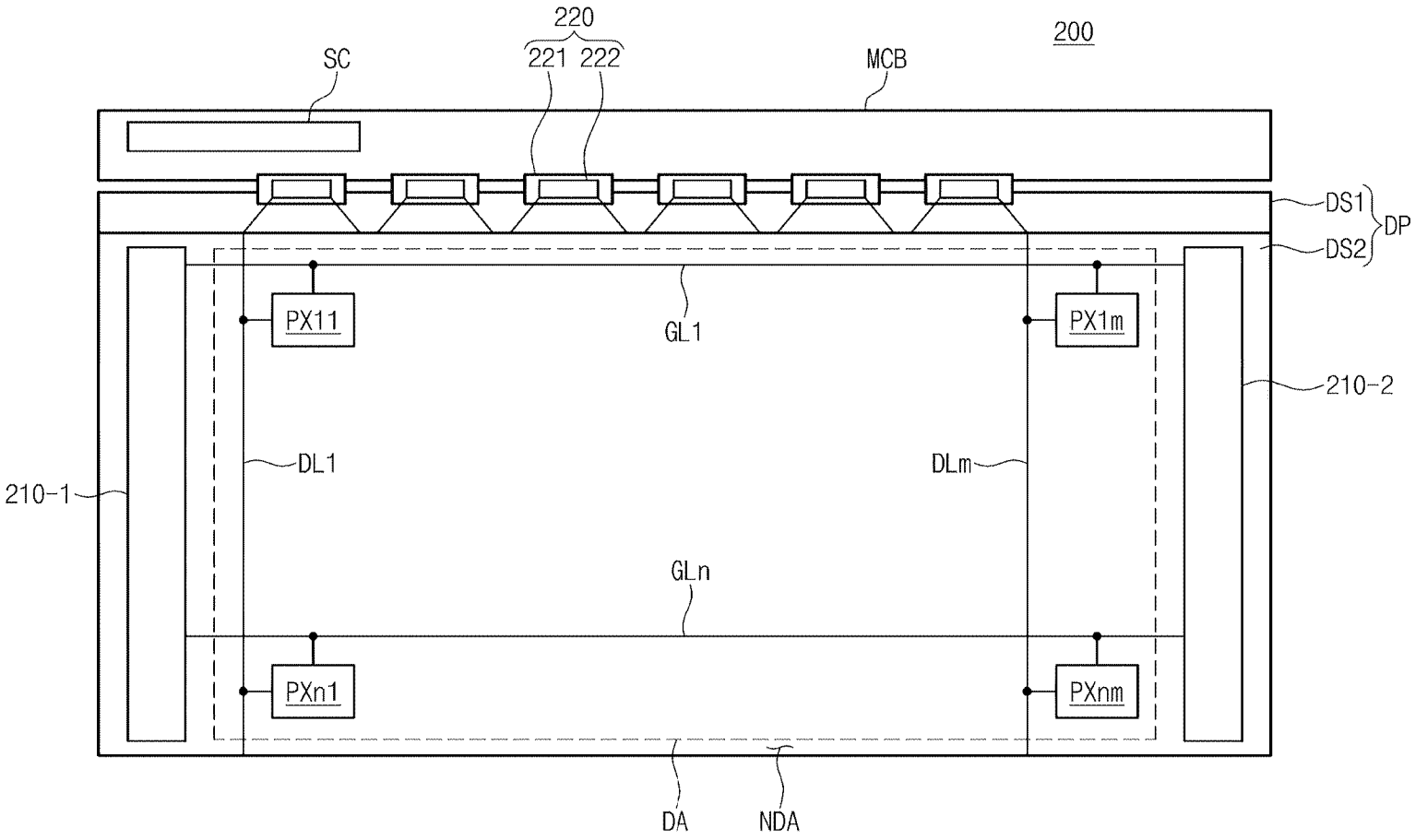
FIG. 11 is a block diagram showing a display device according to another exemplary embodiment.

FIG. 11 is a block diagram showing a display device 200 according to another exemplary embodiment of the present disclosure. Referring to FIG. 11, the display device 200 includes a display panel DP, gate driving circuits 210-1 and 210-2, and a data driving circuit 220. A first substrate DS1, a second substrate DS2, a signal controller SC, a main circuit board MCB, gate lines GL1 to GLn, data lines DL1 to DLm, pixels PX11 to PXnm, a display area DA, and a non-display area NDA, which are included in the display device 200, are the same as those described with reference to FIG. 1.

Different from the display device 100 shown in FIG. 1, the display device 200 shown in FIG. 11 includes first and second gate driving circuits 210-1 and 210-2. The first gate driving circuit 210-1 is disposed at one side of the display panel DP and connected to the gate lines GL1 to GLn. The second gate driving circuit 210-1 is disposed at another side of the display panel DP and connected to the gate lines GL1 to GLn. The first and second gate driving circuits 210-1 and 210-2 respectively drive the gate lines GL1 to GLn in a display area DA.

In detail, the first and second gate driving circuits 210-1 and 210-2 are operated in response to control signals provided from the signal controller SC. Since the first and second gate driving circuits 210-1 and 210-2 substantially simultaneously drive the gate lines GL1 to GLn, the control signals provided from the signal controller SC are required to have the same phase. However, the control signals applied to the first and second gate driving circuits 210-1 and 210-2 from the signal controller SC may have different phases from each other due to a distance between the signal controller SC and the first and second gate driving circuits 210-1 and 210-2, inner wirings, and inner parasitic capacitances. As a result, defects described with reference to FIG. 9 may occur in first driving stages of the first and second gate driving circuits 210-1 and 210-2.

The gate driving circuit according to the present exemplary embodiment applies the start signal STV to the first node NQ in response to the second clock signal CKVB or the first clock signal CKV having a phase opposite to the second clock signal CKVB. Accordingly, although the phases of the control signals are changed as described above, the gate signals are stably output, thereby improving the capability and the reliability of the gate driving circuit.

According to exemplary embodiments of the present disclosure, although the precharging time is shortened due to the delay of the start signal, the voltage of the node used to control the output part is sufficiently precharged and stably maintained to improve the capability and the reliability of the gate driving circuit.

Although certain exemplary embodiments and implementations have been described herein, other embodiments and modifications will be apparent from this description. Accordingly, the inventive concept is not limited to such embodiments, but rather to the broader scope of the presented claims and various obvious modifications and equivalent arrangements.

What is claimed is:

1. A gate driving circuit, comprising:

a plurality of driving stages driving a plurality of gate lines included in a display panel, a first driving stage of the driving stages, which is configured to drive a first gate line of the gate lines, comprising:

a first output transistor configured to output a first carry signal on a basis of a first clock signal in response to a voltage of a first node;

a second output transistor configured to output a first gate signal on the basis of the first clock signal in response to the voltage of the first node;

a first control transistor configured to apply a second clock signal having a phase different from a phase of the first clock signal to a second node;

a second control transistor configured to apply a start signal to the first node in response to a voltage of the second node; and a third control transistor configured to apply a first discharge voltage to the second node in response to the first carry signal.

2. The gate driving circuit of claim 1, wherein the start signal is provided from an external source and the second clock signal corresponds to an inversion signal of the first clock signal.

3. The gate driving circuit of claim 1, wherein the first control transistor comprises an output electrode connected to the second node, and an input electrode and a control electrode configured to commonly receive the second clock signal.

4. The gate driving circuit of claim 1, wherein the second control transistor comprises an input electrode configured to receive the start signal, a control electrode connected to the second node, and an output electrode connected to the first node.

5. The gate driving circuit of claim 1, wherein the third control transistor comprises an input electrode configured to receive the first discharge voltage, a control electrode configured to receive the first carry signal, and an output electrode connected to the second node.

6. The gate driving circuit of claim 1, further comprising a second driving stage to drive a second gate line included in the display panel, wherein the first driving stage is configured to apply the first carry signal to the second driving stage.

7. The gate driving circuit of claim 6, wherein the first driving stage further comprises an inverter part configured to output a switching signal to a third node in response to the first clock signal.

8. The gate driving circuit of claim 7, wherein the first driving stage further comprises:

a fourth control transistor configured to apply the first discharge voltage to the first node in response to a second carry signal; and a fifth control transistor configured to apply the first discharge voltage to the first node in response to the switching signal of the third node.

9. The gate driving circuit of claim 8, wherein the first driving stage further comprises:

a first pull-down transistor configured to apply a second discharge voltage to the first gate signal in response to the switching signal of the third node;

a second pull-down transistor configured to apply the second discharge voltage to the first gate signal in response to the second carry signal;

a third pull-down transistor configured to apply the first discharge voltage to the first carry signal in response to the switching signal of the third node; and a fourth pull-down transistor configured to apply the first discharge voltage to the first carry signal in response to the second carry signal.

10. A gate driving circuit comprising:

a plurality of driving stages respectively configured to drive a plurality of gate lines of a display panel, a first driving stage among the driving stages comprising:

an output part configured to output a first carry signal and a first gate signal, which are generated on the basis of a clock signal, in response to a voltage of a first node;

an inverter part configured to output a switching signal of a second node in response to the clock signal;

a pull-down part configured to decrease the first carry signal and the first gate signal in response to a second carry signal, which is provided from a second driving stage applied with the first carry signal among the driving stages, and the switching signal; and a control part configured to receive a start signal from an external source and controlling the voltage of the first node in response to the start signal, the first carry signal, and the switching signal, wherein the control part is configured to charge the voltage of the first node in response to the switching signal and the start signal.

11. The gate driving circuit of claim 10, wherein the start signal is configured to start an operation of the gate driving circuit.

12. The gate driving circuit of claim 10, wherein the output part comprises:

a first output transistor comprising a control electrode connected to the first node, an input electrode receiving the clock signal, and an output electrode outputting the first gate signal; and a second output transistor comprising a control electrode connected to the first node, an input electrode receiving the clock signal, and an output electrode outputting the first carry signal.

13. The gate driving circuit of claim 12, wherein the control part comprises:

a first control transistor configured to apply the start signal to the first node in response to a voltage of a third node;

a second control transistor configured to apply the switching signal to the third node; and a third control transistor configured to apply a first discharge voltage to the third node in response to the first carry signal.

14. The gate driving circuit of claim 13, wherein the first control transistor comprises an input electrode configured to receive the start signal, a control electrode connected to the third node, and an output electrode connected to the first node.

15. The gate driving circuit of claim 13, wherein the second control transistor comprises an output electrode connected to the third node, an input electrode and a control electrode commonly connected to the second node.

16. The gate driving circuit of claim 13, wherein the third control transistor comprises an input electrode configured to receive the first discharge voltage, a control electrode configured to receive the first carry signal, and an output electrode connected to the third node.

17. The gate driving circuit of claim 13, wherein the control part further comprises:

a fourth control transistor comprising a control electrode configured to receive the second carry signal, an input electrode configured to receive a first discharge voltage, and an output electrode connected to the first node; and a fifth control transistor comprising an input electrode configured to receive the first discharge voltage, a control electrode configured to receive the switching signal, and an output electrode connected to the first node.

18. The gate driving circuit of claim 17, wherein the pull-down part comprises:

a first pull-down part configured to lower the first gate signal in response to the switching signal or the second carry signal; and a second pull-down part configured to lower the first carry signal in response to the switching signal or the second carry signal.

19. The gate driving circuit of claim 18, wherein the first pull-down part comprises:

a first pull-down transistor comprising an input electrode configured to receive a second discharge voltage, a control electrode configured to receive the switching signal, and an output electrode connected to the output electrode of the first output transistor; and a second pull-down transistor comprising an input electrode configured to receive the second discharge voltage, a control electrode configured to receive the second carry signal, and an output electrode connected to the output electrode of the first output transistor.

20. The gate driving circuit of claim 18, wherein the first pull-down part comprises:

a first pull-down transistor comprising an input electrode configured to receive a second discharge voltage, a control electrode configured to receive the switching signal, and an output electrode connected to the output electrode of the second output transistor; and a second pull-down transistor comprising an input electrode configured to receive the second discharge voltage, a control electrode configured to receive the second carry signal, and an output electrode connected to the output electrode of the second output transistor.

* * * * *